US007987785B2

(12) United States Patent
Langlais, II

(10) Patent No.: US 7,987,785 B2
(45) **Date of Patent: *Aug. 2, 2011**

(54) PRINTING MEMBERS HAVING PERMEABILITY-TRANSITION LAYERS AND RELATED METHODS

(75) Inventor: Eugene L. Langlais, II, Amherst, NH (US)

(73) Assignee: Presstek, Inc., Hudson, NH (US)

( * ) Notice: Subject to any disclaimer, the term of this patent is extended or adjusted under 35 U.S.C. 154(b) by 457 days.

This patent is subject to a terminal disclaimer.

(21) Appl. No.: 11/518,525

(22) Filed: Sep. 8, 2006

(65) Prior Publication Data

US 2007/0144385 A1 Jun. 28, 2007

Related U.S. Application Data

(60) Provisional application No. 60/715,035, filed on Sep. 8, 2005.

(51) Int. Cl.
*B41N 1/08* (2006.01)
*B41N 3/00* (2006.01)

(52) U.S. Cl. ..... 101/467; 101/463.1; 101/464; 101/465; 430/270.1

(58) Field of Classification Search ..... 101/463.1, 101/464, 465, 467; 430/270.1
See application file for complete search history.

(56) References Cited

U.S. PATENT DOCUMENTS

| | | | | |
|---|---|---|---|---|
| 3,458,311 | A * | 7/1969 | Alles | 430/273.1 |
| 4,104,072 | A * | 8/1978 | Golda et al. | 430/155 |
| 6,472,119 | B1 * | 10/2002 | Verschueren et al. | 430/270.1 |
| 6,534,238 | B1 * | 3/2003 | Savariar-Hauck et al. | 430/270.1 |
| 7,073,440 | B2 * | 7/2006 | Langlais et al. | 101/467 |

FOREIGN PATENT DOCUMENTS

| | | | |
|---|---|---|---|
| EP | 1 023 994 | A1 | 8/2000 |
| EP | 1 025 991 | A1 | 8/2000 |
| EP | 1 249 341 | A1 | 10/2002 |
| EP | 1 522 417 | A1 | 4/2005 |

OTHER PUBLICATIONS

International Preliminary Report on Patentability for PCT/US2006/034852 dated Mar. 11, 2008.
Communication Pursuant to Article 94(3) EPC issued by European Patent Office for EP06803114.5 on Jun. 18, 2008.
International Search Report for International Application No. PCT/US06/034852 dated Jan. 30, 2007.
Written Opinion for International Application No. PCT/US06/034852 dated Jan. 30, 2007.

* cited by examiner

*Primary Examiner* — Joshua D Zimmerman
*Assistant Examiner* — Shema T Freeman
(74) *Attorney, Agent, or Firm* — Bingham McCutchen LLP

(57) ABSTRACT

Permeability transitions rather than ablation mechanisms facilitate selective removal of the imaging layer of a lithographic plate, which allows for imaging with low-power lasers that need not impart ablation-inducing energy levels.

18 Claims, 6 Drawing Sheets

PRINTING MEMBERS HAVING PERMEABILITY-TRANSITION LAYERS AND RELATED METHODS

RELATED APPLICATION

The present application claims priority to and the benefits of U.S. Provisional Application Ser. No. 60/715,035, filed on Sep. 8, 2005, the entire disclosure of which is hereby incorporated by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the wetted printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems generally rely on removal of an energy-absorbing layer from the lithographic plate to create an image. Exposure to laser radiation may, for example, cause ablation—i.e., catastrophic overheating—of the ablated layer in order to facilitate its removal. Accordingly, the laser pulse must transfer substantial energy to the absorbing layer. This means that even low-power lasers must be capable of very rapid response times, and imaging speeds (i.e., the laser pulse rate) must not be so fast as to preclude the requisite energy delivery by each imaging pulse.

DESCRIPTION OF THE INVENTION

Brief Summary of the Invention

The present invention utilizes permeability transitions rather than ablation mechanisms to facilitate selective removal of the imaging layer of a lithographic plate, which allows for imaging with low-power lasers that need not impart ablation-inducing energy levels. In a first aspect, the invention involves a lithographic printing member comprising a topmost first layer that undergoes, in response to heat, a transition from an impermeable state to a thermally rearranged state exhibiting enhanced permeability; a second layer comprising a material that is soluble and removable following exposure to heat; a third layer; and a substrate disposed below the first, second, and third layers. The first and third layers can have the same or opposite affinities for ink and/or a liquid to which ink will not adhere. In addition, the first and second layers can have the same or opposite affinities for ink and/or a liquid to which ink will not adhere. Transition of the first layer to a permeable state allows solvent to penetrate the first layer and dissolve the second layer. Thus de-anchored, the first layer may be removed by mechanical or other action, thereby exposing the third layer.

The transitions the first and second layer undergo may involve a transition from a crystalline state to an amorphous state. Substantially all of the first layer exposed to the imaging radiation may undergo the transition. The second layer is intrinsically soluble or becomes sufficiently so upon exposure to the imaging radiation to be removed (or rendered easily removable) through the action of the solvent.

The first layer may contain a material, such as a pigment or dye, that absorbs imaging radiation and transfers thermal energy to the second layer. Alternatively, the second layer may contain such a pigment or dye, or it may be present in both layers.

In some embodiments, the third layer is disposed below the second layer, and the substrate and the third layer may have the same affinity for ink and/or a liquid to which ink will not adhere. In other embodiments, the third layer is disposed between the first layer and the second layer, and the third layer is permeable to solvent. The third layer may comprise a material that absorbs imaging radiation.

In some embodiments, the printing member comprises a top layer disposed above the first layer. The top layer is permeable to an aqueous fluid and exhibits the same affinity as the first layer for ink and/or a liquid to which ink will not adhere. The top layer may also comprise a material that absorbs imaging radiation. The substrate may comprise a substrate modifier thereabove; the substrate modifier has the same or opposite affinity as the substrate for ink and/or a liquid to which ink will not adhere.

In another aspect, the invention involves a method of imaging the lithographic printing members described above. In one embodiment, the printing member is exposed to imaging radiation in an imagewise pattern, which causes the first layer exposed to the radiation to undergo a transition from an impermeable state to a permeable state and the second layer to become or remain in a soluble state. The printing member is next subjected to a solvent (e.g., an aqueous fluid), which permeates the first layer and dissolves the soluble portions of the second layer. The first layer can then be removed, creating an imagewise lithographic pattern on the printing member.

It should be stressed that, as used herein, the term "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention when taken in conjunction with the accompanying drawings, in which.

DETAILED DESCRIPTION OF THE PREFERRED EMBODIMENTS

1. Imaging Apparatus

Figure 1:
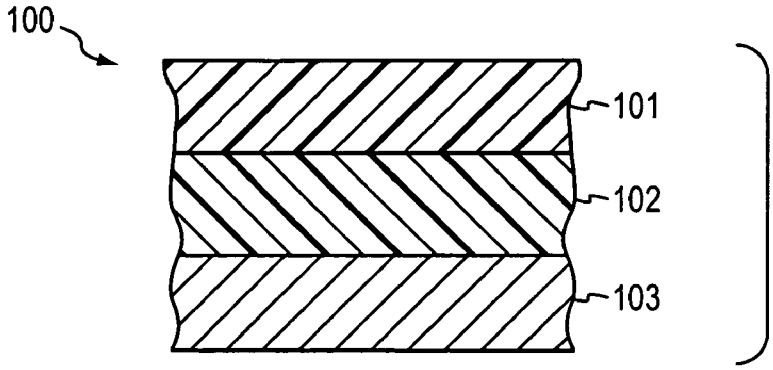
FIG. 1 is an enlarged sectional view of an embodiment of a printing member according to the invention that contains a first layer, a second layer, and a substrate.

An imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the infrared (IR) or near-IR region are fully described in U.S. Pat. Nos. Re. 35,512 ("the '512 patent") and 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, in an array-type system for on-press applications it is generally preferable to employ a plurality of lasers and guide their outputs to a single writing array. The writing array is then shifted, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

2. Lithographic Printing Members with Permeability-Transition Layers

Figure 2:
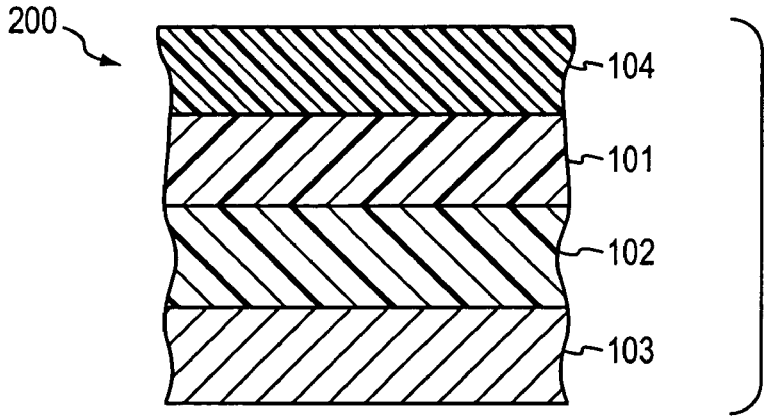
FIG. 2 is an enlarged sectional view of an embodiment of a printing member according to the invention that contains a permeable top layer, a first layer, a second layer, and a substrate.
Figure 3:
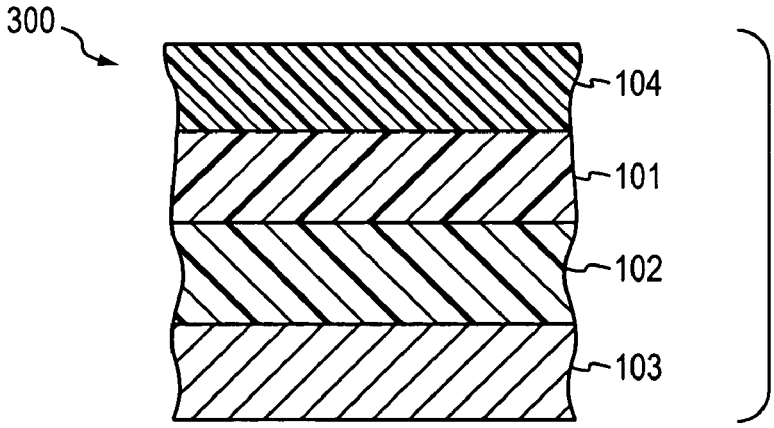
FIG. 3 is an enlarged sectional view of an embodiment of a printing member according to the invention that contains a permeable top layer which serves as the heating layer, a first layer, a second layer, and a substrate.
Figure 4:
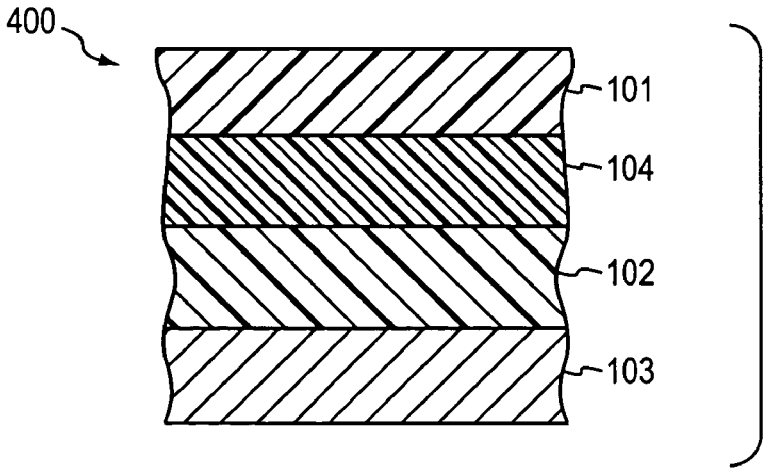
FIG. 4 is an enlarged sectional view of an embodiment of a printing member according to the invention that contains a first layer, a second layer, a substrate, and a third layer in between the first and second layers.
Figure 5:
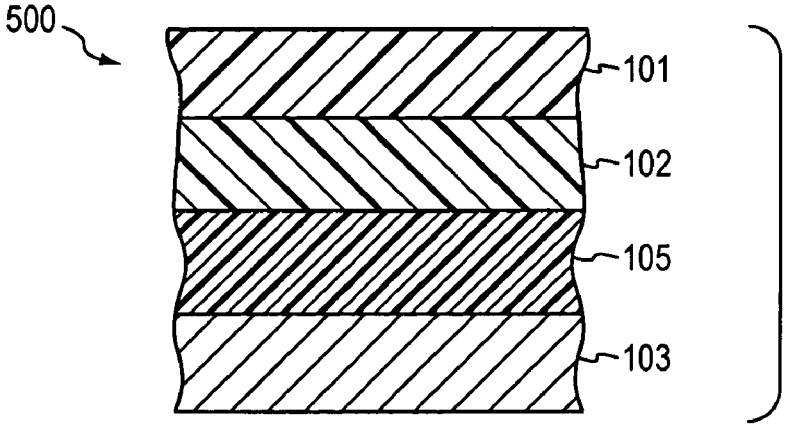
FIG. 5 is an enlarged sectional view of an embodiment of a printing member according to the invention that contains a first layer, a second layer, a substrate, and a third layer in between the second layer and the substrate.

FIG. 1 illustrates an embodiment 100 of a printing member according to the invention that includes a first layer 101 that undergoes a transition in response to heat, a second layer 102, and a substrate 103. FIG. 2 illustrates a variation 200 that includes a solvent-permeable top layer 104 located above the first layer 101. FIG. 3 illustrates yet another variation 300 that includes a solvent-permeable top layer 104 located above the first layer 101, and in which the first and second layers do not absorb imaging radiation. FIG. 4 illustrates embodiment 400 of a printing member according to the invention that includes a first layer 101 that undergoes a transition in response to heat, a second layer 102, a substrate 103, and the optional solvent-permeable layer 104 now located between the second layer and the substrate. FIG. 5 illustrates embodiment 500 of printing members according to the invention that includes a first layer 102 that undergoes a transition in response to heat, a second layer 102, a substrate 103, and an optional third layer 105 located between the second layer and the substrate. The third layer 105 is neither permeable or soluble. These layers and their functions will now be described in detail.

2.1. First Layer 101

The first layer 101 includes a polymer that becomes permeable to a solvent such as water and yet resists solubilization by such solvents. In general, this layer acts as a protective barrier above the second layer 102 and, if it is the top layer of the printing member, exhibits a lithographic affinity opposite to that of at least one layer below; for example, the first layer 101 may be oleophilic or hydrophilic. The first layer 101 may be transparent to imaging radiation, or may instead absorb imaging radiation, as in embodiment 300, so as to impart heat to the second layer 102, facilitating its transition. Polymers utilized in this layer should exhibit good adhesion to the second layer 102 and be highly wear-resistant. A cross-linking agent may be added to the first layer 101 to enhance these characteristics. Suitable polymers may be either water-based or solvent-based and can be oleophilic or hydrophilic. The first layer 101 may (but again, need not) include a material that absorbs imaging radiation and transfers thermal energy to the second layer 102.

Suitable polymers for an oleophilic first layer 101 include, but are not limited to, non-polar substances such as polystyrene, polymethyl methacrylate, polyphenols, polyethylene, and the like.

Suitable polymers for a hydrophilic first layer 101 include, but are not limited to, crystalline polyols including polyoxyalkylene polyols, the alkylene portion of which is a straight chain such as poly(oxyethylene) diol and poly(oxytetramethylene) diol; polyester polyols which are the reaction products of polyol(s) having from 2 to about 12 methylene groups and polycarboxylic acid(s) having from 2 to about 12 methylene groups; polyester polyols made by ring-opening polymerization of lactones such as ϵ-caprolactone; and blends thereof. Additional amorphous hydroxy-functional materials useful for first layer 101 also include those reaction products of polyoxyethylene glycol, polyoxypropylene glycol, 1,2-polyoxybutylene glycol, 1,4-polyoxybutylene glycol that are capped or copolymerized with ethylene oxide. The polyether glycol may be the reaction product of propylene oxide copolymerized with ethylene oxide, for example, or those compounds which are homopolymers or copolymers formed from one or more ingredients including ethylene oxide, propylene oxide, 1,2-butylene oxide, 1,4-butylene oxide and mixtures thereof. These materials may have a random or block configuration. The number average molecular weight of the resultant polyether polyol is from about 1000 to about 8000 grams/mole and generally from about 2000 to about 4000 grams/mole. Preferred crystalline polyols include poly(oxytetramethylene) diol, polyhexamethylene adipate diol (made by reacting an excess of 1,6-hexamethylene diol and adipic acid), polyhexamethylene sebacate diol (made by reacting an excess of 1,6-hexamethylene diol and sebacic acid), and polyhexamethylene dodecanedioate diol (made by reacting an excess of 1,6-hexamethylene diol and dodecanedioic acid). Examples of commercially available crystalline polyols include, for example, poly(oxytetramethylene) polyols sold under the tradename TERATHANE (available from E.I. duPont de Nemours & Co.); polyester polyols sold under the tradenames LEXOREZ (available from Inolex Chemical Co.), RUCOFLEX (available from Ruco Polymer Corp.), and FORMREZ (available from Witco Chemical Co.); and polycaprolactone polyols sold under the tradename TONE (available from Union Carbide).

The first layer 101 may also be formed from a combination of one or more polymers such as so-called "intelligent polymers," which may be based on poly (N-isopropylacrylamide ("PNIPAAM") as the thermal-responsive unit, and poly (L-lactic acid) ("PLLA") as the biodegradable hydrophobic unit, for example.

Other combination polymers useful for layer 101 include amphiphilic segmented copolymers. Amphiphilic segmented copolymers include at least one segment B that includes a hydrophobic polymer. Any of a number of hydrophobic polymers can be used, such as, but not limited to, polysiloxane such as polydimethylsiloxane and polydiphenylsiloxane, perfluoropolyether, polystyrene, polyoxypropylene, polyvinylacetate, polyoxybutylene, polyisoprene, polybutadiene, polyvinylchloride, polyalkylacrylate, polyalkylmethacrylate, polyacrylonitrile, polypropylene, PTHF, polymethacrylates, polyacrylates, polysulfones, polyvinylethers, and poly(propylene oxide), and copolymers thereof.

The hydrophobic segment preferably contains a predominant amount of hydrophobic monomers. A hydrophobic monomer is one that typically yields a homopolymer that is insoluble in water and can absorb less than 10% by weight of water.

Suitable hydrophobic monomers include $C_1$-$C_{18}$ alkyl and $C_3$-$C_{18}$ cycloalkyl acrylates and methacrylates, $C_3$-$C_{18}$ alkylacrylamides and methacrylamides, acrylonitrile, methacrylonitrile, vinyl $C_1$-$C_{18}$ alkanoates, $C_2$-$C_{18}$ alkenes, $C_2$-$C_{18}$ haloalkenes, styrene, (lower alkyl)styrene, $C_4$-$C_{12}$ alkyl vinyl ethers, $C_2$-$C_{10}$ perfluoro-alkyl acrylates and methacrylates and correspondingly partially fluorinated acrylates and methacrylates, $C_3$-$C_{12}$ perfluoroalkylethylthiocarbonylaminoethyl acrylates and methacrylates, acryloxy- and methacryloxyalkylsiloxanes, N-vinylcarbazole, $C_1$-$C_{12}$ alkyl esters of maleic acid, fumaric acid, itaconic acid, mesaconic acid, vinyl acetate, vinyl propionate, vinyl butyrate, vinyl valerate, chloroprene, vinyl chloride, vinylidene chloride, vinyltoluene, vinyl ethyl ether, perfluorohexyl ethylthiocarbonylaminoethyl methacrylate, isobornyl methacrylate, trifluoroethyl methacrylate, hexa-fluoroisopropyl methacrylate, hexafluorobutyl methacrylate, tristrimethylsilyloxysilylpropyl methacrylate (TRIS), and 3-methacryloxypropylpentamethyldisiloxane.

In addition to the hydrophobic segment B, the amphiphilic segmented copolymer includes at least one segment A which includes at least one hydrophilic polymer, such as, but not limited to, polyoxazoline, polyethylene glycol, polyethylene oxide, polyvinyl alcohol, polyvinylpyrrolidone, polyacrylamide, poly(meth)acrylic acid, polyethylene oxide-copolypropyleneoxide block copolymers, poly(vinylether), poly(N,N-dimethylacrylamide), polyacrylic acid, polyacyl alkylene imine, polyhydroxyalkylacrylates such as hydroxyethyl methacrylate (HEMA), hydroxyethyl acrylate, and hydroxypropyl acrylate, polyols, and copolymeric mixtures of two or more of the above mentioned polymers, natural polymers such as polysaccharides and polypeptides, and copolymers thereof, and polyionic molecules such as polyallylammonium, polyethyleneimine, polyvinylbenzyltrimethylammonium, polyaniline, sulfonated polyaniline, polypyrrole, and polypyridinium, polythiophene-acetic acids, polystyrenesulfonic acids, zwitterionic molecules, and salts and copolymers thereof.

The hydrophilic segment preferably contains a predominant amount of hydrophilic monomers. A hydrophilic comonomer is one that typically yields a homopolymer that is soluble in water or can absorb at least 10% by weight of water.

Suitable hydrophilic monomers are hydroxyl-substituted lower alkyl acrylates and methacrylates, acrylamide, methacrylamide, (lower alkyl) acrylamides and methacrylamides, N,N-dialkyl-acrylamides, ethoxylated acrylates and methacrylates, polyethyleneglycol-mono methacrylates and polyethyleneglycolmonomethylether methacrylates, hydroxyl-substituted (lower alkyl)acrylamides and methacrylamides, hydroxyl-substituted lower alkyl vinyl ethers, sodium vinylsulfonate, sodium styrenesulfonate, 2-acrylamido-2-methylpropanesulfonic acid, N-vinylpyrrole, N-vinyl-2-pyrrolidone, 2-vinyloxazoline, 2-vinyl-4,4'-dialkyloxazolin-5-one, 2- and 4-vinylpyridine, vinylically unsaturated carboxylic acids having a total of 3 to 5 carbon atoms, amino(lower alkyl)(where the term amino also includes quaternary ammonium), mono(lower alkylamino)(lower alkyl) and di(lower alkylamino)(lower alkyl)acrylates and methacrylates, allyl alcohol, 3-trimethylammonium 2-hydroxypropylmethacrylate chloride (Blemer, QA, for example from Nippon Oil), dimethylaminoethyl methacrylate (DMAEMA), dimethylaminoethylmethacrylamide, glycerol methacrylate, and N-(1,1-dimethyl-3-oxobutyl)acrylamide.

Certain copolymers are also useful. One such material is the copolymer polystyrene-b-polyethylene oxide (PS-b-PEO), is made of polystyrene (PS), an amorphous polymer with a glass-transition temperature of 100° C., and polyethylene oxide (PEO), a crystalline polymer with an equilibrium melting temperature of 69° C. Because of their distinct chemical natures, PS and PEO strongly segregate from each other, so after the PS matrix glassifies, the crystallized PEO blocks are completely confined within the nanospaces of the copolymer.

Illustrative of the many different types of temperature responsive polymers are polymers and copolymers of N-isopropyl acrylamide (NIPAAm). PolyNIPAAm is a thermally sensitive polymer that precipitates out of water at 32° C., which is its lower critical solution temperature (LCST), or cloud point. When polyNIPAAm is copolymerized with a more hydrophilic comonomer such as acrylamide, the LCST is higher and the copolymer has a broader temperature range of precipitation. The opposite occurs when it is copolymerized with a more hydrophobic comonomer, such as t-butyl acrylamide, and these copolymers usually are more likely to retain the sharp transition characteristic of PNIPAAm. Accordingly, copolymers can be produced having a desired LCST and a desired temperature range of precipitation.

Oligomers of NIPAAm (or other vinyl monomers) having a reactive group at one end can be prepared by the radical polymerization of NIPAAm using AIBN as initiator, plus a chain transfer agent with a thiol (H—SH) group at one end and the desired "reactive" group (e.g. —OH, —COOH, —$NH_2$) at the other end. See, e.g., Chen et al., *Bioconiugate Chem.* 4: 509-514 (1993) and Chen et al., *J. Biomaterials Sci. Polymer Ed.* 5: 371-382 (1994). Appropriate quantities of NIPAAm, AIBN and the chain transfer reagent in DMF are placed in a thick-walled polymerization tube and the mixtures are degassed by freezing and evacuating and then thawing (4 times). After cooling for the last time, the tubes are evacuated and sealed prior to polymerization. The tubes are immersed in a water bath at 60° C. for 4 hours. The resulting polymer is isolated by precipitation into diethyl ether and weighed to determine yield. The molecular weight of the polymer is determined either by titration (if the end group is amine or carboxyl) or by vapor phase osmometry (VPO). If a pH-sensitive oligomer or polymer is desired, then acidic monomers such as methacrylic acid or acrylic acid, maleic acid or anhydride, AMPS, or the phosphate ester monomers described above ("Phosmer") can be used, as can basic monomers, such as aminoethyl methacrylate (AEMA), or vinyl formamide, which can be hydrolyzed to polyvinyl amine after polymerization.

When IR or near-IR imaging radiation is employed, suitable absorbing materials can include a wide range of dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example. Any of these materials may be dispersed in a prepolymer before cross-linking into a final film. Alternatively, the absorber may be a chromophore chemically integral with the polymer backbone; see, e.g., U.S. Pat. No. 5,310,869.

The absorbing material should minimally affect adhesion between the first layer 101 and adjacent layers. Surface-modified carbon-black pigments sold under the trade designation CAB-O-JET 200 by Cabot Corporation, Bedford, Mass. are found to minimally disrupt adhesion at loading levels that provide adequate sensitivity for heating. Another suitable carbon-black pigment is BONJET BLACK CW-1, available from Orient Corporation, Springfield, N.J.

An exemplary first layer 101 may be prepared by mixing and coating methods known in the art, for example, combining a polyurethane polymer, an IR absorbing material (e.g., CAB-O-JET 200 carbon black), and hexamethoxy-methylmelamine crosslinking agent in a suitable solvent, followed by the addition of a suitable amine-blocked p-toluenesulfonic acid catalyst to form the finished coating mix. The coating mix is then applied to the second layer 102 using one of the conventional methods of coating application, such as wire-wound rod coating, reverse roll coating, gravure coating, or slot die coating, and subsequently dried to remove the volatile liquids and to form a coating layer.

The first layer 101 is coated in this invention typically at a thickness in the range of from about 0.1 to about 20 microns and more preferably in the range of from about 0.1 to about 0.25 micron. After coating, the layer is dried and preferably cured at a temperature of between 145° C. and 165° C.

2.2 Second Layer 102

The second layer 102 layer captures the image on the printing member through dissolution. Layer 102 may be intrinsically soluble or may instead undergo a phase change or other physico-chemical transition from an insoluble state to a soluble state in response to heat. Polymers utilized in this layer should exhibit good adhesion to the first layer 101 or optional top layer 104 above and to the substrate 103 or the third layer 105 below, and be highly wear-resistant. The second layer 102 may also include a material that absorbs imaging radiation.

The second layer 102 may, in response to heat, undergo a transition from an insoluble, crystalline state to a soluble, amorphous state. In one embodiment, the transition is reversible, which allows a printing member according to the invention to be "erased" and re-imaged. Erasure may be accomplished, for example, by heating an imaged plate in an oven and allowing it to cool slowly. It is believed that heating and slow cooling allows for recrystallization of the second layer 102 back to its insoluble state. Once cooled, the plate can be re-exposed to imaging radiation, and the new image will be revealed without any evidence of the first image. This "erasing" procedure can be repeated more than once.

Preferably, the unimaged portions of the second layer 102 withstand repeated application of fountain solution during printing without substantial degradation or solubilization. In particular, degradation of the second layer 102 may take the form of swelling of the layer and/or loss of adhesion to adjacent layers. This swelling and/or loss of adhesion may deteriorate the printing quality and dramatically shorten the press life of the printing member. One test of withstanding the repeated application of fountain solution during printing is a wet rub resistance test. Satisfactory results in withstanding the repeated application of fountain solution and not being excessively soluble in water or in a cleaning solution are represented by the retention of the 3% dots in the wet rub resistance test.

In general, polymeric materials suitable for the second layer 102 include natural and non-natural polymers having exposed polar moieties such as hydroxyl or carboxyl groups. Examples of suitable polymers include, but are not limited to, polyethylene derivatives (such as polyethylene oxide), cellulose derivatives (such as hydroxyethyl cellulose and carboxymethyl cellulose), polyvinyl derivatives (such as polyvinyl alcohol and polyvinyl ether), polysaccharides (such as dextrin, dextran, and starch derivatives), polyglycolides, gelatines, and polyols, particularly crystalline. Suitable crystalline polyols include polyoxyalkylene polyols, the alkylene portion of which is a straight chain such as poly(oxyethylene) diol and poly(oxytetramethylene) diol; polyester polyols which are the reaction products of polyol(s) having from 2 to about 12 methylene groups and polycarboxylic acid(s) having from two to about 12 methylene groups; and polyester polyols made by ring-opening polymerization of lactones such as ϵ-caprolactone; and blends thereof. Preferred crystalline polyols include poly(oxytetramethylene) diol, polyhexamethylene adipate diol (made by reacting an excess of 1,6-hexamethylene diol and adipic acid), polyhexamethylene sebacate diol (made by reacting an excess of 1,6-hexamethylene diol and sebacic acid), and polyhexamethylene dodecanedioate diol (made by reacting an excess of 1,6-hexamethylene diol and dodecanedioic acid). Examples of commercially available crystalline polyols include, for example, poly(oxytetramethylene) polyols sold under the tradename TERATHANE (available from E.I. duPont de Nemours & Co.); polyester polyols sold under the tradenames LEXOREZ (available from Inolex Chemical Co.), RUCOFLEX (available from Ruco Polymer Corp.), and FORMREZ (available from Witco Chemical Co.); and polycaprolactone polyols sold under the tradename TONE (available from Union Carbide).

Other suitable polymers are straightforwardly identified by those of skill in the art, e.g., by reference to "Handbook of Water-Soluble Gums and Resins" by Robert L. Davidson (1980, McGraw-Hill Co.) (incorporated herein by reference). In a preferred embodiment, the second layer 102 includes polyvinyl alcohol.

Polymers with relatively low degrees of crystallinity may also be suitable for use in the second layer. For example, heating a polymer above its melting point followed by slow cooling may enhance the crystallinity of the polymer. Alternatively, reversibly cross-linking a polymer may lead to a more crystalline structure. For example, a high-molecular-weight polyacrylamide may be reversibly cross-linked via hydrogen bonding or multi-valent metals to form a water-insoluble, partially-crystalline state. Heat causes the cross-linked polymer to change phase from the water-insoluble, crystalline state to a water-soluble, amorphous state, allowing for image capture on the printing member.

In designing a suitable formulation, cross-linking can be used to control resolubility, filler pigments to modify and/or control rewettability, and pigments and/or dyes to impart absorbance of laser energy. In particular, fillers such as $TiO_2$ pigments, zirconia, silicas and clays are particularly useful in imparting rewettability without resolubility. In one embodiment, the second layer 102 contains a zirconium crosslinking agent, preferably ammonium zirconyl carbonate.

The second layer 102 may contain a material that absorbs imaging radiation. Near-IR absorbers for second layers 102 based on polyvinyl alcohol include conductive polymers, e.g., polyanilines, polypyrroles, poly-3,4-ethylenedioxypyrroles, polythiophenes, and poly-3,4-ethylenedioxythiophenes. As polymers, these are incorporated into the second layer 102 in the form of dispersions, emulsions, colloids, etc. due to their limited solubility. Alternatively, they can be formed in situ from monomeric components included in the second layer 102 as cast or applied to the second layer 102 subsequent to the curing process, i.e., by a post-impregnation or saturation process. For conductive polymers based on polypyrroles, the catalyst for polymerization conveniently provides the "dopant" that establishes conductivity.

Certain inorganic absorbers, dispersed within the polymer matrix, also serve particularly well in connection with second layers 102 based on polyvinyl alcohol. These include TiON, TiCN, tungsten oxides of chemical formula $WO_{3-x}$, where $0<x<0.5$ (with $2.7 \leqq x \leqq 2.9$ being preferred), and vanadium oxides of chemical formula $V_2O_{5-x}$, where $0<x<1.0$ (with $V_6O_{13}$ being preferred). Other suitable absorbing materials include dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example.

The second layer 102 is typically coated at a thickness in the range of from about 0.1 to about 40 microns and more preferably in the range of from about 0.1 to about 0.5 micron. After coating, the layer is dried and subsequently cured at a temperature between 135° C. and 185° C. for between 10 seconds and 3 minutes, and more preferably at a temperature between 145° C. and 165° C. for between 30 seconds and 2 minutes.

In one embodiment, at least a sufficient portion of layer 102 exposed to the imaging radiation undergoes a transition from an insoluble state to a soluble state. By "sufficient" it is meant that enough of the layer becomes soluble to be removed (or to be easily removable) through the action of the solvent. Lithographic printing members according to this embodiment include a first layer 101 that has an affinity for ink and/or a liquid to which ink will not adhere that is opposite that of the substrate 103 and/or the optional third layer 105. In these embodiments, the second layer 102 can have either the same or opposite affinity as the first layer 101 for ink and/or a liquid to which ink will not adhere. However, it is preferable to provide a second layer 102 and a first layer 101 of like affinities because the second layer 102 will accept or reject ink in the same manner as the overlying first layer 101 in those areas where the first layer 101 is damaged during handling or the printmaking process, thus maintaining print quality and prolonging the press life of the printing member.

It should be understood that both the imaging radiation source and the lithographic printing member can be manipulated in combination to produce the desired transition in the second layer 104.

2.3 Substrate 103

The substrate 103 provides dimensionally stable mechanical support to the printing member and may dissipate heat accumulated in the second layer 102 or in the optional third layer 105 to prevent its ablation. Suitable substrate materials include, but are not limited to, alloys of aluminum, chromium, and steel, which may have another metal such as copper plated over one surface. Preferred thicknesses range from 0.004 to 0.02 inch, with thicknesses in the range 0.005 to 0.012 inch being particularly preferred. Alternatively, substrate 103 may be paper or a polymer film (e.g., polyesters such as polyethylene terephthalate and polyethylene naphthalate, polycarbonates, polyurethane, acrylic, polyamide, or phenolic polymers). Preferred thicknesses for such films range from 0.003 to 0.02 inch, with thicknesses in the range of 0.005 to 0.015 inch being particularly preferred. When using a polyester substrate, it may prove desirable to interpose a primer coating between the second layer 102 or optional third layer 105 and the substrate 103; suitable formulations and application techniques for such coatings are disclosed, for example, in U.S. Pat. No. 5,339,737, the entire disclosure of which is hereby incorporated by reference. It should be understood that any of the embodiments 100-500 may be fabricated with a metal, paper, polymer or other substrate material.

Non-image areas of the printing member exposed following imaging have an affinity opposite to that of the image areas for ink and/or a liquid to which ink will not adhere. In embodiments of the invention wherein those portions of the second layer 102 exposed to imaging radiation change phase, the first layer 101 and the substrate 103 have opposite lithographic affinities. In embodiments that contain a third layer 105 (e.g., embodiment 500), on the other hand, the first layer 101 and the substrate 103 need not have opposite lithographic affinities because the first and third layers 101 and 105 have opposite affinities, as described below. However, it is preferable to provide a substrate 103 and a third layer 105 of like affinities to promote adhesion and to accommodate damage to the third layer 105 without loss of performance. Specifically, even though the third layer 105 is typically not soluble in aqueous solutions and is not removed during the imaging process, it can still be scratched or damaged during the printmaking process. A substrate 103 of like affinity will accept or reject ink in the same manner as the overlying third layer 105 in those areas where the third layer 105 is damaged, thus maintaining print quality and prolonging the press life of the printing member.

In general, a metal substrate must undergo special treatment in order to provide a hydrophilic surface. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water.

A structured or grained surface can also be produced by controlled oxidation, a process commonly called "anodizing." An anodized aluminum substrate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying second layer 102 in embodiments that do not include an intervening third layer 105.

Preferred hydrophilic substrate materials include aluminum that has been mechanically, chemically, and/or electrically grained with or without subsequent anodization. In addition, some metal layers need only be cleaned, or cleaned and anodized, to present a sufficiently hydrophilic surface.

A wide variety of papers may be utilized as a substrate 103. Typically, papers are saturated with a polymeric treatment to improve dimensional stability, water resistance, and strength during the wet lithographic printing.

Examples of suitable polymeric substrates 103 include, but are not limited to, polyesters such as polyethylene terephthalate and polyethylene naphthalate, polycarbonates, polystyrene, polysulfones, and cellulose acetate. Various substrate modifiers may also be employed. For example, polymeric substrates 103 can further comprise a hydrophilic (e.g., polyvinyl alcohol) or oleophilic (e.g., polyester) coating applied to at least one surface of a polymer film, thereby modifying the affinity of the film. Also, as described in U.S. Pat. No. 5,829,353 (the entire disclosure of which is hereby incorporated by reference), the affinity of a polymeric substrate substrate 103 may be modified through implantation of one or more metallic materials, typically in the form of ions and/or atoms (or molecules), rather than by texturing or deposition of a new surface layer. A preferred polymeric substrate is polyethylene terephthalate film, such as the polyester films available under the trademarks of MYLAR and MELINEX from E. I. duPont de Nemours Co., Wilmington, Del., for example.

2.4 Optional Top Layer 104

The optional top layer is designed to be more robust on press and more scratch-resistant than the first layer 101, thus maintaining print quality and prolonging the press life of the printing member. The optional top layer 104 includes a polymer that is permeable to a solvent such as water and yet resistant to solubilization by such solvents. In some embodiments, this layer acts as a protective barrier above the first layer 101 and exhibits a lithographic affinity opposite to that of at least one layer below; for example, the optional top layer 104 may be oleophilic or hydrophilic. In other embodiments, the optional top layer 104 is located between the first and second layers 101 and 102 and exhibits a lithographic affinity opposite to that of at least one layer below; for example, the optional top layer 104 may be oleophilic or hydrophilic. The optional top layer 104 may be transparent to imaging radiation, or may instead absorb imaging radiation so as to impart heat to the first layer 101, facilitating its transition. Polymers utilized in this layer should exhibit good adhesion to adjacent layers and be highly wear-resistant.

For embodiments where the optional top layer 104 is transparent to imaging radiation, suitable polymers include hydroxy-functional, carboxy-functional, or epoxy-functional polymers, for example. The polymers are cross-linked to a greater extent than those in the first layer 101 to provide added durability while maintaining sensitivity to the imaging radiation.

Suitable polymers for an oleophilic optional top layer 104 include, but are not limited to, polyurethanes, cellulosic polymers such as nitrocellulose, polycyanoacrylates, and epoxy polymers. For example, polyurethane-based materials are typically extremely tough and may have thermosetting or self-curing capability. The optional top layer 104 may also be formed from a combination of one or more polymers, such as an epoxy polymer combined with a polyurethane polymer in the presence of a crosslinking agent and a catalyst, for example.

Suitable polymers for a hydrophilic optional top layer 104 include, but are not limited to, starch, dextran, alginic acid, and hydroxyethyl cellulose.

Examples of useful amorphous polyols for use in layer 104 include polyoxyalkylene polyols, the alkylene portion of which is a branched alkylene such as poly(oxypropylene) diol and poly(oxybutylene) diol; aliphatic polyols such as poly (butadiene) diol, hydrogenated poly(butadiene) diol, and poly(ethylene-butylene) diol; polyester polyols formed during reactions between and/or among the following diols and diacids: neopentyl diol, ethylene diol, propylene diol, 1,4-butanediol, 1,6-hexanediol, adipic acid, orthophthalic acid, isophthalic acid, and terephthalic acid; and blends thereof. Preferably, the amorphous polyol is glassy or liquid at room temperature and exhibits a $T_g$ less than or equal to 50° C., more preferably less than or equal to 30° C. Preferred amorphous polyols include poly(oxypropylene) diol; poly(oxybutylene) diol; and poly(ethylene-butylene) diol. Examples of commercially available amorphous polyols include, for example, poly(oxypropylene) diols sold under the tradename ARCOL such as ARCOL 1025 or 2025 (available from Arco Chemical Co.); poly(oxybutylene) diols sold under the tradename POLYGLYCOL such as B 100-2000 (available from Dow Chemical Co.); and poly(ethylene-butylene) diol sold as HPVM 2201 (available from Shell Chemical Co.).

The absorbing material should minimally affect adhesion between the optional top layer 104 and adjacent layers. Surface-modified carbon-black pigments sold under the trade designation CAB-O-JET 200 by Cabot Corporation, Bedford, Mass. are found to minimally disrupt adhesion at loading levels that provide adequate sensitivity for heating. Another suitable carbon-black pigment is BONJET BLACK CW-1, available from Orient Corporation, Springfield, N.J.

An exemplary optional top layer 104 may be prepared by mixing and coating methods known in the art, for example, combining a polyurethane polymer, an IR absorbing material (e.g., CAB-O-JET 200 carbon black), and hexamethoxy-methylmelamine crosslinking agent in a suitable solvent, followed by the addition of a suitable amine-blocked p-toluenesulfonic acid catalyst to form the finished coating mix. The coating mix is then applied to the first layer 101 or the second layer 102 using one of the conventional methods of coating application, such as wire-wound rod coating, reverse roll coating, gravure coating, or slot die coating, and subsequently dried to remove the volatile liquids and to form a coating layer.

The first layer 101 or the second layer 102 is coated in this invention typically at a thickness in the range of from about 0.1 to about 20 microns and more preferably in the range of from about 0.1 to about 0.25 micron. After coating, the layer is dried and preferably cured at a temperature of between 145° C. and 165° C.

When IR or near-IR imaging radiation is employed, suitable absorbing materials can include a wide range of dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example. Any of these materials may be dispersed in a prepolymer before cross-linking into a final film. Alternatively, the absorber may be a chromophore chemically integral with the polymer backbone; see, e.g., U.S. Pat. No. 5,310,869.

2.5 Optional Third Layer 105

The optional third layer 105 provides a thermal barrier during laser exposure to prevent heat loss and possible damage to the substrate 103 and exhibits a lithographic affinity opposite to that of the first layer 101; for example, the optional third layer 105 may be oleophilic or hydrophilic. In some embodiments, the optional third layer 105 includes a polymer that is impermeable to a solvent such as water and resistant to solubilization by such solvents; for example, the optional third layer 105 may serve as the printing surface. In some embodiments, the optional third layer 105 includes a polymer that is thermally responsive and becomes soluble. In these embodiments, the optional third layer 105 exhibits a lithographic affinity opposite to that of the first layer 101 and similar to that of the substrate 103.

When IR or near-IR imaging radiation is employed, suitable absorbing materials can include a wide range of dyes and pigments, as described above. The optional third layer 105 may be fabricated using any of the materials and methods described above. Other suitable materials include, for example, cross-linked polyvinyl alcohol (e.g., as described in the '737 patent) for hydrophilic affinity or polyester or a polyacrylate for oleophilic affinity.

3. Imaging Techniques

Figure 6A:
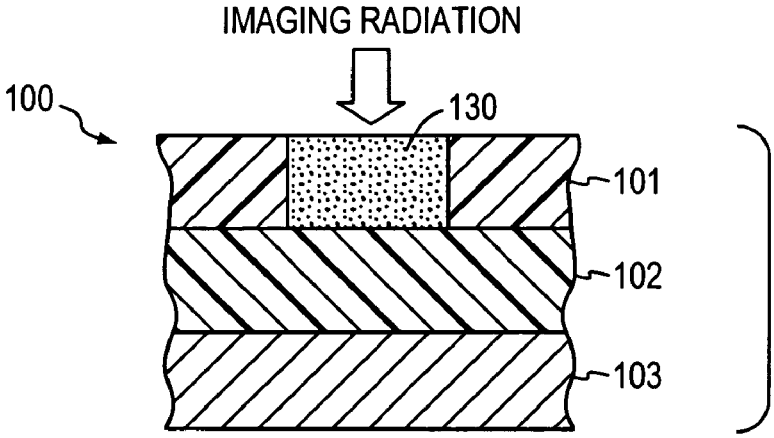
FIGS. 6A-6C are enlarged sectional views of the printing members of FIGS. 1 and 2 illustrating an imaging mechanism according to the invention.
Figure 6B:
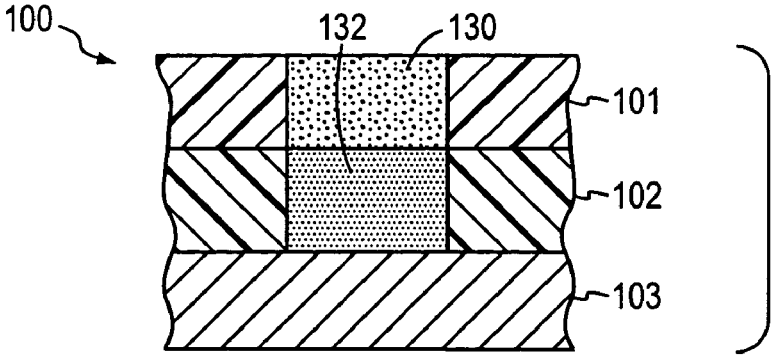
Figure 6C:
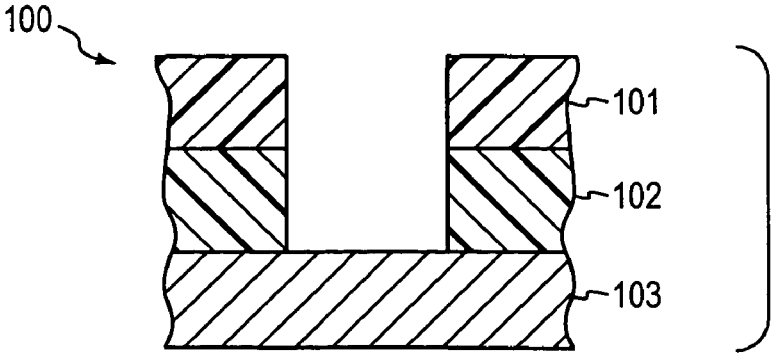

FIGS. 6A-6C illustrate the consequences of imaging the printing member 100, wherein substantially all of the second layer 102 exposed to the imaging radiation changes phase. In one embodiment, the first layer 101 of the printing member 100 contains a material that absorbs imaging radiation. As illustrated in FIG. 6A, the exposed area 130 of the first layer 101 absorbs the imaging pulse and converts the energy to heat. With reference to FIG. 6B, the heat causes substantially all of the portion 130 of the first layer 101 exposure to change from an impermeable state to a permeable state. A solvent (e.g., an aqueous fluid) applied post-imaging to the printing member 100 permeates the first layer 101 in the region of exposure and sufficiently dissolves the portion 132 of the second layer 102 to de-anchor it from substrate 103 and/or layer 101. The dissolved portion 132 of the second layer 102, along with the portion 130 of the first layer 101 that overlies it, can then be removed (e.g., by rubbing or as a consequence of the mechanical action that takes place during the print "make ready" process) to expose the substrate 103 below, as illustrated in FIG. 6C. Because layer 101 and substrate 103 exhibit different lithographic affinities, the result is an image spot.

In other embodiments, the second layer 102 of the printing member 100 contains a material that absorbs imaging radiation. In these embodiments, the imaging pulse passes through the first layer 101 and is absorbed by the second layer 102, and heat from layer 102 causes the permeability transition in layer 101 as described above.

In still other embodiments, both the first and second layers 101 and 102 contain absorbing material. In these embodiments, the exposed areas of the first layer 101 absorb the imaging pulse and convert the energy to heat, which causes layer 101 to undergo transition to a permeable state. Any imaging radiation that is not absorbed by the first layer 101 is absorbed by the second layer 102, which further heats layer 101 to cause the transition described above.

In embodiment 200, an optional top layer 104 that is transparent to imaging radiation is located above the first layer 101. Operation of this embodiment is substantially as described above for embodiment 100. In particular, layer 104 does not impede penetration of solvent into and through layer 102 following its transition to a permeable state. Layer 104 is removed, along with layers 101 and 102, in the region of exposure by mechanical action.

Figure 7A:
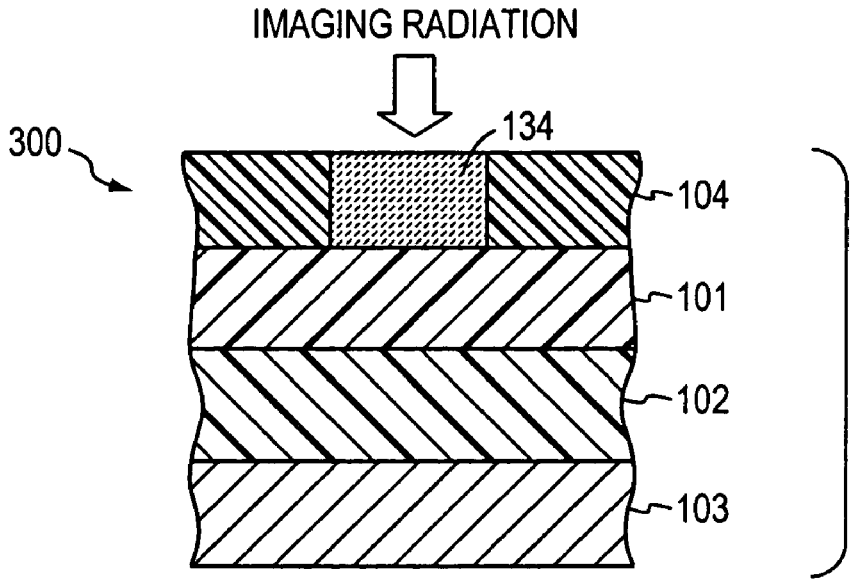
FIGS. 7A-7C are enlarged sectional views of the printing member of FIG. 3 illustrating an imaging mechanism according to the invention.
Figure 7B:
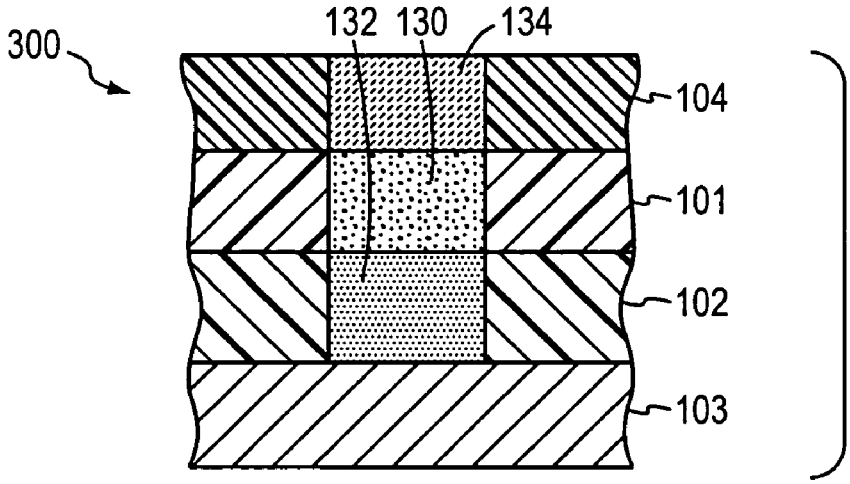
Figure 7C:
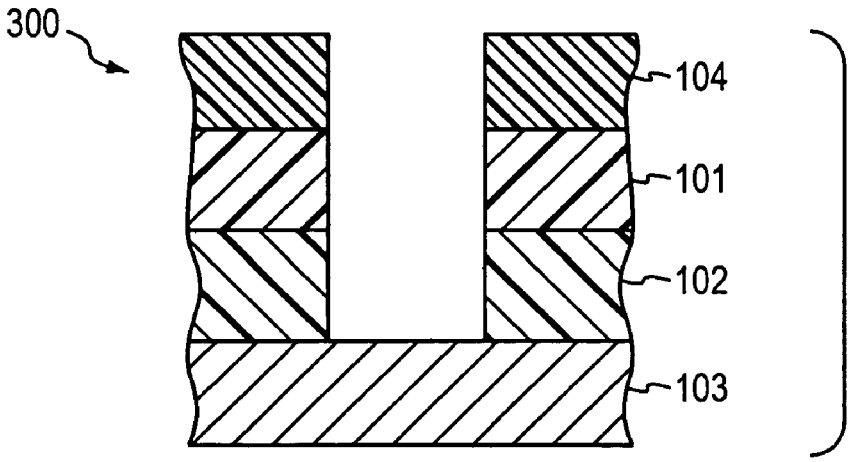

FIGS. 7A-7C illustrate the consequences of exposing the printing member 300 to the output of an imaging laser. In the illustrated embodiment, the top layer 104 contains a material that absorbs imaging radiation. As illustrated in FIG. 7A, the exposed area 134 of the top layer 104 absorbs the imaging pulse and converts the energy to heat. With reference to FIG. 7B, the heat is transferred to the portion 130 of the first layer 101 immediately below the exposed area 134 of the top layer 104, causing substantially all of the portion 130 of the first layer 101 to change from an impermeable state to a permeable state. A solvent (e.g., an aqueous fluid) applied post-imaging to the printing member 300 permeates the first layer 101 and dissolves the portion 132 of the second layer 102. The dissolved portion 132 of the second layer 102, along with the portion 130 of the first layer 101 and the portion 134 of the top layer 104 that overlie it, can then be removed (e.g., by rubbing or as a consequence of the mechanical action that takes place during the print "make ready" process) to expose the substrate 103 below, as illustrated in FIG. 7C.

Figure 8A:
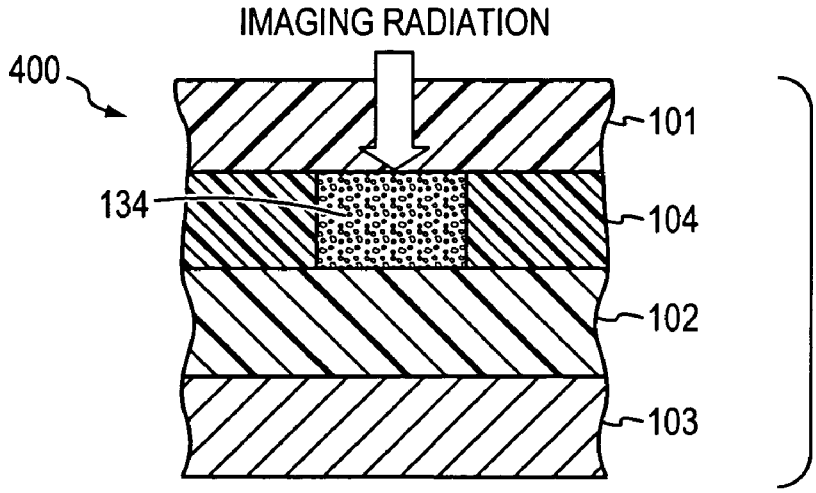
FIGS. 8A-8C are enlarged sectional views of the printing member of FIG. 4 illustrating an imaging mechanism according to the invention.
Figure 8B:
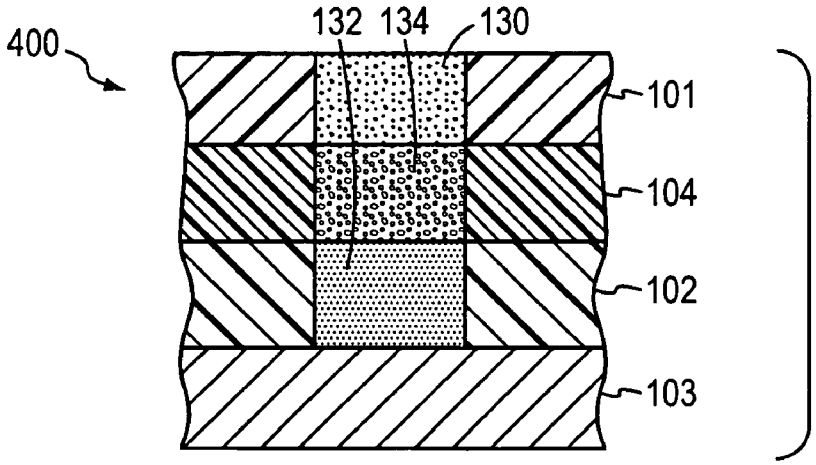
Figure 8C:
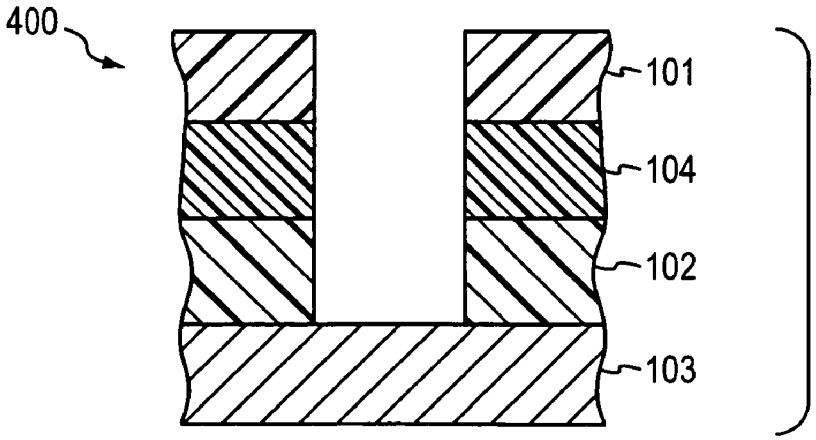

FIGS. 8A-8C illustrate the consequences of exposing the printing member 400 to the output of an imaging laser. In the illustrated embodiment, the layer 104 contains a material that absorbs imaging radiation and is now located between the first layer 101 and the second layer 102. As illustrated in FIG. 8A, the exposed area 134 of the layer 104 absorbs the imaging pulse and converts the energy to heat. With reference to FIG. 8B, the heat is transferred to the portion 130 of the first layer 101 immediately above the exposed area 134 of the layer 104, causing substantially all of the portion 130 of the first layer 101 to change from an impermeable state to a permeable state. A solvent (e.g., an aqueous fluid) applied post-imaging to the printing member 300 permeates the first layer 101 and the layer 104 (which is inherently permeable) and dissolves the portion 132 of the second layer 102. The dissolved portion 132 of the second layer 102, along with the portion 130 of the first layer 101 and the portion 134 of the layer 104 that overlie it, can then be removed (e.g., by rubbing or as a consequence of the mechanical action that takes place during the print "make ready" process) to expose the substrate 103 below, as illustrated in FIG. 8C.

In other embodiments, the second layer 102 of the printing member 400 contains a material that absorbs imaging radiation. In these embodiments, the imaging pulse passes through the first layer 101 and is absorbed by the second layer 102, causing the transition described above.

In still other embodiments of printing member 400, both the first and second layers 101 and 102 contain absorbing material. In these embodiments, the exposed areas of the first layer 101 absorb the imaging pulse and convert the energy to heat. Any imaging radiation that is not absorbed by the first layer 101 is absorbed by the second layer 102.

Figure 9A:
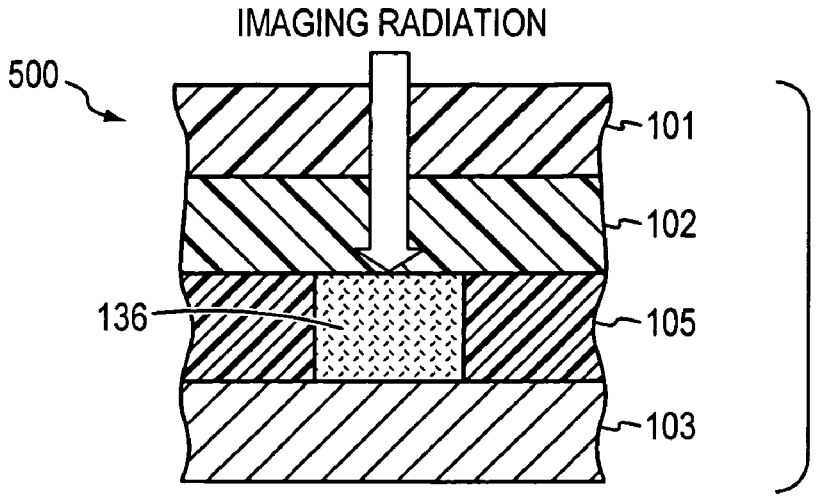
FIGS. 9A-9C are enlarged sectional views of the printing member of FIG. 5 illustrating an imaging mechanism according to the invention.
Figure 9B:
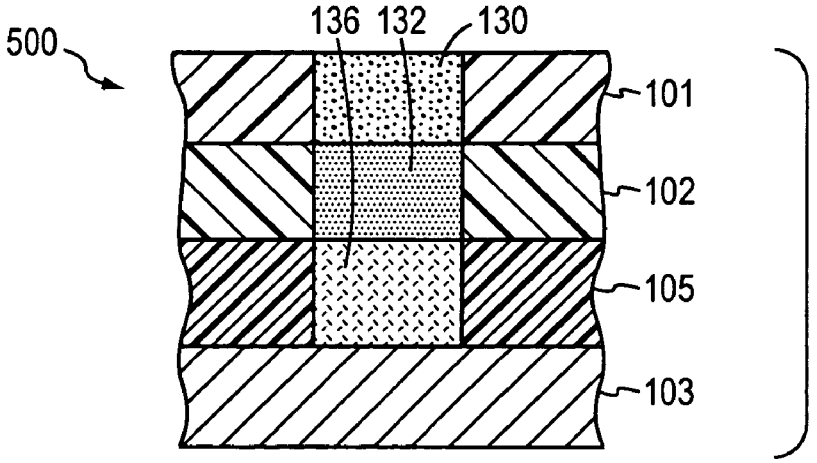
Figure 9C:
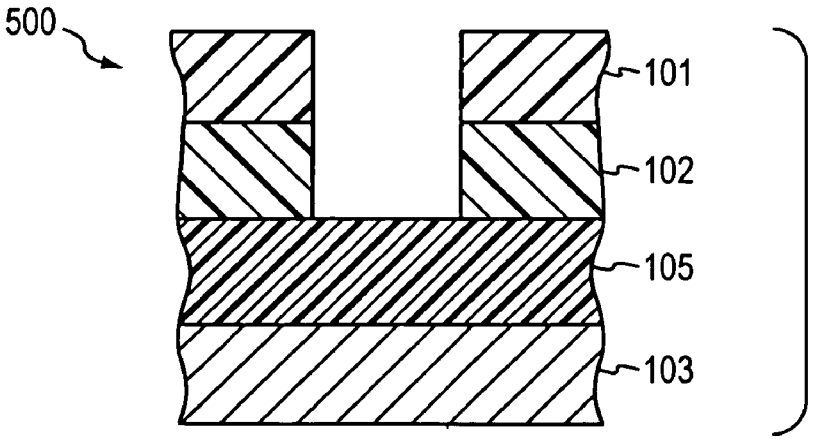

FIGS. 9A-9C illustrate the consequences of exposing the printing member 500 to the output of an imaging laser. In the illustrated embodiment, the third layer 105 contains a material that absorbs imaging radiation and is located between the second layer 102 and the substrate 103. As illustrated in FIG. 9A, the exposed area 136 of the third layer 105 absorbs the imaging pulse and converts the energy to heat. With reference to FIG. 9B, the heat is transferred to the portion 130 of the first layer 101 two layers above the exposed area 136 of the third layer 105, causing substantially all of the portion 130 of the first layer 101 to change from an impermeable state to a permeable state. A solvent (e.g., an aqueous fluid) applied post-imaging to the printing member 500 permeates the first layer 101 and dissolves the portion 132 of the second layer 102. The dissolved portion 132 of the second layer 102, along with the portion 130 of the first layer 101 that overlies it, can then be removed (e.g., by rubbing or as a consequence of the mechanical action that takes place during the print "make ready" process) to expose the substrate 103 below, as illustrated in FIG. 9C.

In some embodiments, the second layer 102 of the printing member 500 contains a material that absorbs imaging radiation. In these embodiments, the imaging pulse passes through the first layer 101 and is absorbed by the second layer 102. In other embodiments, the first layer 101 of the printing member 500 contains a material that absorbs imaging radiation. In these embodiments, the imaging pulse is absorbed by the first layer 101.

In some embodiments of printing member 500, both the first and second layers 101 and 102 contain absorbing material. In these embodiments, the exposed areas of the first layer 101 absorb the imaging pulse and convert the energy to heat, which is transferred to the second layer 102. Any imaging radiation that is not absorbed by the first layer 101 is absorbed by the second layer 102, causing the transition described above.

Figure 10:
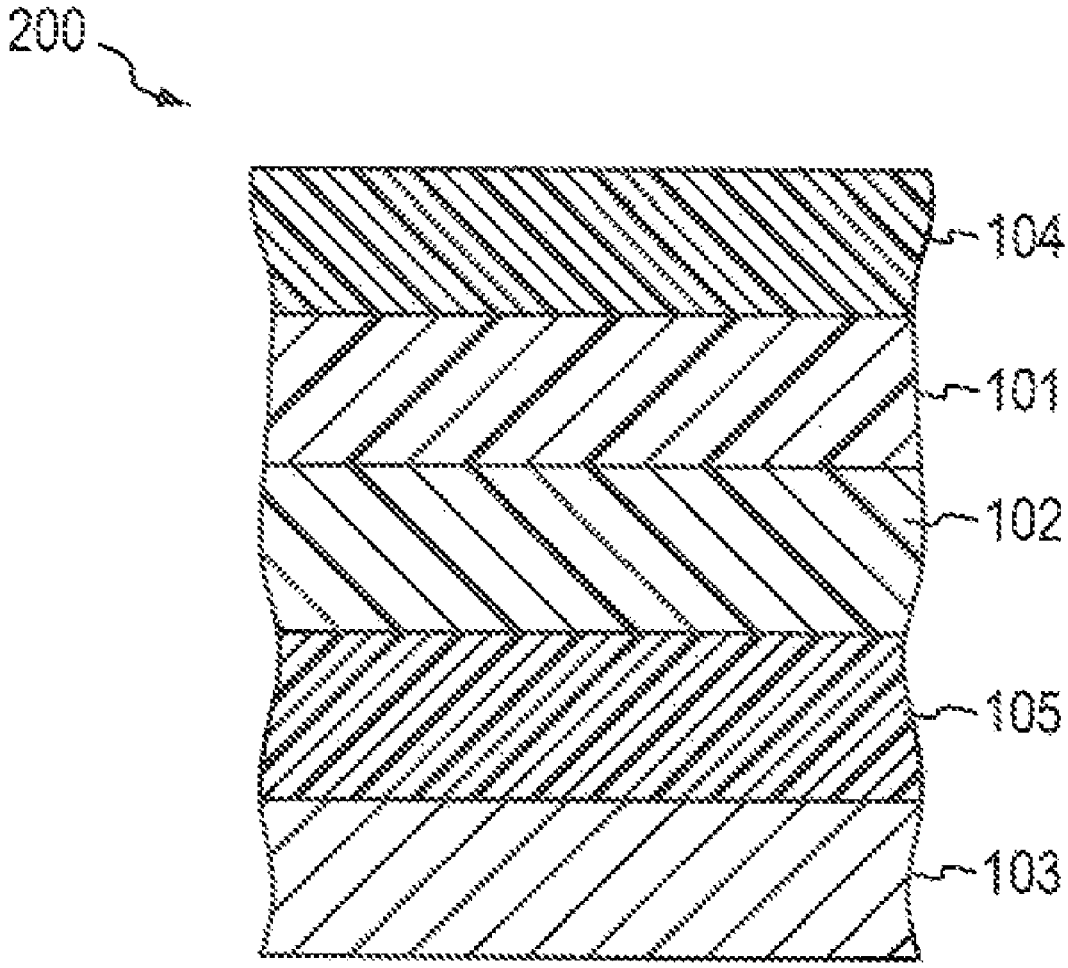
FIG. 10 is an enlarged sectional view of an embodiment of a printing member according to the invention that contains a top layer, a first layer, a second layer, a third layer, and a substrate.

FIG. 10 illustrates a variation of a printing member 200 according to the invention that includes the optional third layer 105 described above. As shown, the printing member includes a solvent-permeable top layer 104 located above a first layer 101 that undergoes a transition in response to heat, which is in turn located above a second layer 102, the third layer 105, and a substrate 103.

In all embodiments of the invention, the imaging pulse delivers the proper amount of energy to the printing member to cause the desired transition(s). The amount of energy required is a function of parameters such as laser power, the duration of the pulse, the intrinsic absorption of the heat-sensitive layer (as determined, for example, by the concentration of absorber therein), the thickness of the heat-sensitive layer, and the presence of a thermally conductive layer beneath the heat-sensitive layer. These parameters are readily determined by the skilled practitioner without undue experimentation.

It will be seen that the foregoing techniques provide a basis for improved lithographic printing and superior plate constructions. The terms and expressions employed herein are used as terms of description and not of limitation, and there is no intention in the use of such terms and expressions of excluding any equivalents of the features shown and described or portions thereof. Instead, it is recognized that various modifications are possible within the scope of the invention claimed.

What is claimed is:

1. A lithographic printing member comprising:

(a) an insoluble first layer that undergoes, in response to heat, a transition from an impermeable state to an insoluble thermally rearranged state exhibiting enhanced permeability;

(b) an insoluble second layer, disposed below the first layer, that undergoes, in response to heat, a transition to a soluble state;

(c) a third layer; and (d) a substrate disposed below the first, second, and third layers, wherein the first layer and the third layer have opposite affinities for at least one of ink and a liquid to which ink will not adhere.

2. The member of claim 1 wherein the first layer comprises a material that absorbs imaging radiation and transfers heat to the second layer.

3. The member of claim 2 wherein the first layer is polymeric and the material comprises an IR-absorbing pigment dispersed therein.

4. The member of claim 2 wherein the first layer is polymeric and the material comprises an IR-absorbing dye dispersed therein.

5. The member of claim 1 wherein the second layer comprises a material that absorbs imaging radiation.

6. The member of claim 5 wherein the second layer is polymeric and the material comprises an IR-absorbing pigment dispersed therein.

7. The member of claim 5 wherein the second layer is polymeric and the material comprises an IR-absorbing dye dispersed therein.

8. The member of claim 1 wherein the first and second layers comprise a material that absorbs imaging radiation.

9. The member of claim 1 wherein the third layer is disposed below the second layer.

10. The member of claim 9 wherein the substrate and the third layer have the same affinity for at least one of ink and a liquid to which ink will not adhere.

11. The member of claim 1 wherein the third layer is disposed between the first layer and the second layer, the third layer being permeable to solvent.

12. The member of claim 11 wherein the third layer comprises a material that absorbs imaging radiation.

13. The member of claim 1 further comprising a top layer disposed above the first layer, the top layer being permeable to an aqueous fluid and having the same affinity as the first layer for at least one of ink and a liquid to which ink will not adhere.

14. The member of claim 13 wherein the top layer comprises a material that absorbs imaging radiation.

15. The member of claim 1 wherein the substrate further comprises a substrate modifier disposed above the substrate, the substrate modifier having the same or opposite affinity as the substrate for at least one of ink and a liquid to which ink will not adhere.

16. The member of claim 1 wherein the first layer is removable with an aqueous solution.

17. The member of claim 1 wherein the first-layer transition is a phase change from a water-impermeable state to a water-permeable state.

18. A lithographic printing member comprising:

(a) an insoluble first layer that undergoes, in response to heat, a transition from an impermeable state to an insoluble thermally rearranged state exhibiting enhanced permeability;

(b) an insoluble second layer that undergoes, in response to heat, a transition to a soluble and removable state;

(c) a third layer disposed below the second layer; and (d) a substrate disposed below the first, second, and third layers, wherein the first layer and the third layer have opposite affinities for at least one of ink and a liquid to which ink will not adhere.

* * * * *